US007752873B2

(12) United States Patent
Jeanveau

(10) Patent No.: US 7,752,873 B2
(45) Date of Patent: Jul. 13, 2010

(54) PELTING SYSTEM

(76) Inventor: Florent Jeanveau, R.R. #3 Site 39, Box 5, Sudbury, ON (CA) P3E 4N1

( * ) Notice: Subject to any disclaimer, the term of this patent is extended or adjusted under 35 U.S.C. 154(b) by 614 days.

(21) Appl. No.: 10/784,286

(22) Filed: Feb. 24, 2004

(65) Prior Publication Data

US 2005/0183473 A1 Aug. 25, 2005

(51) Int. Cl.
*C14B 1/26* (2006.01)

(52) U.S. Cl. ..... 69/19.1

(58) Field of Classification Search ..... 69/1.5, 69/19, 19.1, 19.2, 19.3, 22
See application file for complete search history.

(56) References Cited

U.S. PATENT DOCUMENTS

| | | | | | |
|---|---|---|---|---|---|
| 962,391 | A | * | 6/1910 | Scott | 69/19.2 |
| 1,169,145 | A | * | 1/1916 | Gibson | 69/19.2 |
| 1,355,928 | A | * | 10/1920 | Townsend | 69/19.1 |
| 1,398,907 | A | * | 11/1921 | Milton | 69/19.2 |
| 1,755,118 | A | * | 4/1930 | Oney | 69/19.2 |
| 1,932,167 | A | * | 10/1933 | Weigand et. al. | 69/19.2 |
| 2,283,367 | A | * | 5/1942 | Hintz | 38/102.4 |
| 2,290,457 | A | * | 7/1942 | Cordie | 69/19.1 |
| 2,494,949 | A | * | 1/1950 | Langdahl | 69/19.1 |
| 3,204,435 | A | * | 9/1965 | Olson | 69/19.1 |
| 3,407,634 | A | * | 10/1968 | Nelson | 69/19.1 |
| 4,274,270 | A | * | 6/1981 | Johnson | 69/19.3 |
| 5,564,293 | A | * | 10/1996 | Black et al. | 69/19.2 |

OTHER PUBLICATIONS http://www.pumpkinlady.com/pattern.htm (Dec. 1, 2002).*

* cited by examiner

*Primary Examiner*—Shaun R Hurley
(74) *Attorney, Agent, or Firm*—Fay Sharpe LLP

(57) ABSTRACT

The present invention relates to a fur-pelt system adapted to maintain the highest in pelt quality in relation to industry standards. The pelt system comprises: a stretch board having a generally rectangular form and a planar surface through which a plurality of evenly spaced perforations are made to accept nails or the like. Several sized patterns are provided in order to best fit a pelt to the largest pelt size according to industry specifications with minimal amounts of waste fur. A user thereby estimates the end-size of a newly caught fur and proceeds to stretch said fur into the closest to perfect form desired by industry thereby increasing user's chances of a more valuable pelt.

15 Claims, 2 Drawing Sheets

PELTING SYSTEM

FIELD OF THE INVENTION

The present invention relates to a fur-pelt system adapted to maintain the highest in pelt quality in relation to industry standards. The pelt system comprises: a stretch board having a generally rectangular form and a planar surface through which a plurality of evenly spaced perforations are made to accept nails or the like. Several sized patterns are provided in order to best fit a pelt to the largest pelt size according to industry specifications with minimal amounts of waste fur. A user thereby estimates the end-size of a newly caught fur and proceeds to stretch said fur into the closest to perfect form desired by industry thereby increasing user's chances of a more valuable pelt.

BACKGROUND OF THE INVENTION

Trapping for fur has been a long-lived trading activity, and many make a living doing so. However, as the ages advanced, fur buyers have been increasingly particular about the furs they purchase, expecting more from traders even at lower trading prices.

In the last few years, the fur industry has come to standardize pelt shapes and sizes, in that, for example a beaver's pelt is categorized in seven different sizes of a specific oval shape.

It is desirable for trappers to obtain the largest pelt possible while maintaining this desired shape at the same time, all while creating the least waste possible.

The applicant is aware of several attempts in prior art to provide means stretching pelts to a desired shape. An example may be had by referring to prior art U.S. Pat. No. 2,283,367 of Hintz, issued May 19, 1942 depicting a resilient inter-connected band forming a circle having a plurality of slidable pins adapted to attach to said band while a pointed tip protrudes upward from the upper edge of said band thereby providing pelt attaching means to said circular band. However, the natural geometric form of a looped band is in fact circular, not oval therefore failing to accurately target the oval form desired by buyers.

Another example of prior art may be had in referring to U.S. Pat. No. 2,290,457 of Taylor, issued Jul. 21, 1942, which depicts a frame work adapted with an array of return hooks attached thereto, and slidable interconnections between four hooked member. However effective this invention may be to literally stretch pelts, it does fail in providing guidance to form and size of said pelts.

Another example of prior art may be had in referring to U.S. Pat. No. 2,494,949 of Langdahl, issued Apr. 21, 1947, which describes yet another circular band on which bead chains hooked to a pelt and attached to said band. Again this invention fails to provide the desired templated size and form.

While many attempts have been made to provide trappers with means of pelting furs, none of these prior art inventions seem to provide means of accurately stretching a pelt to conform to measurable industry standards all while reducing fur waste in the process.

SUMMARY OF THE INVENTION

It is thus the object of the present invention to provide trappers with means of pelting furs, having means of accurately stretching a pelt to conform to measurable industry standards all while reducing fur waste in the process.

In one aspect of the invention, a printed-paper template and instructions may be provided to user.

In another aspect of the invention, prefabricated pelt boards may be provided.

Accordingly, the system of the present invention provides trappers with means of pelting furs, with means of accurately stretching a pelt to conform to measurable industry standards all while reducing fur waste in the process.

The utility of this device includes but is not limited to furs.

BRIEF DESCRIPTION OF THE DRAWINGS

These and other advantages of the invention will become apparent upon reading the following detailed description and upon referring to the drawings in which:—

Figure 1:
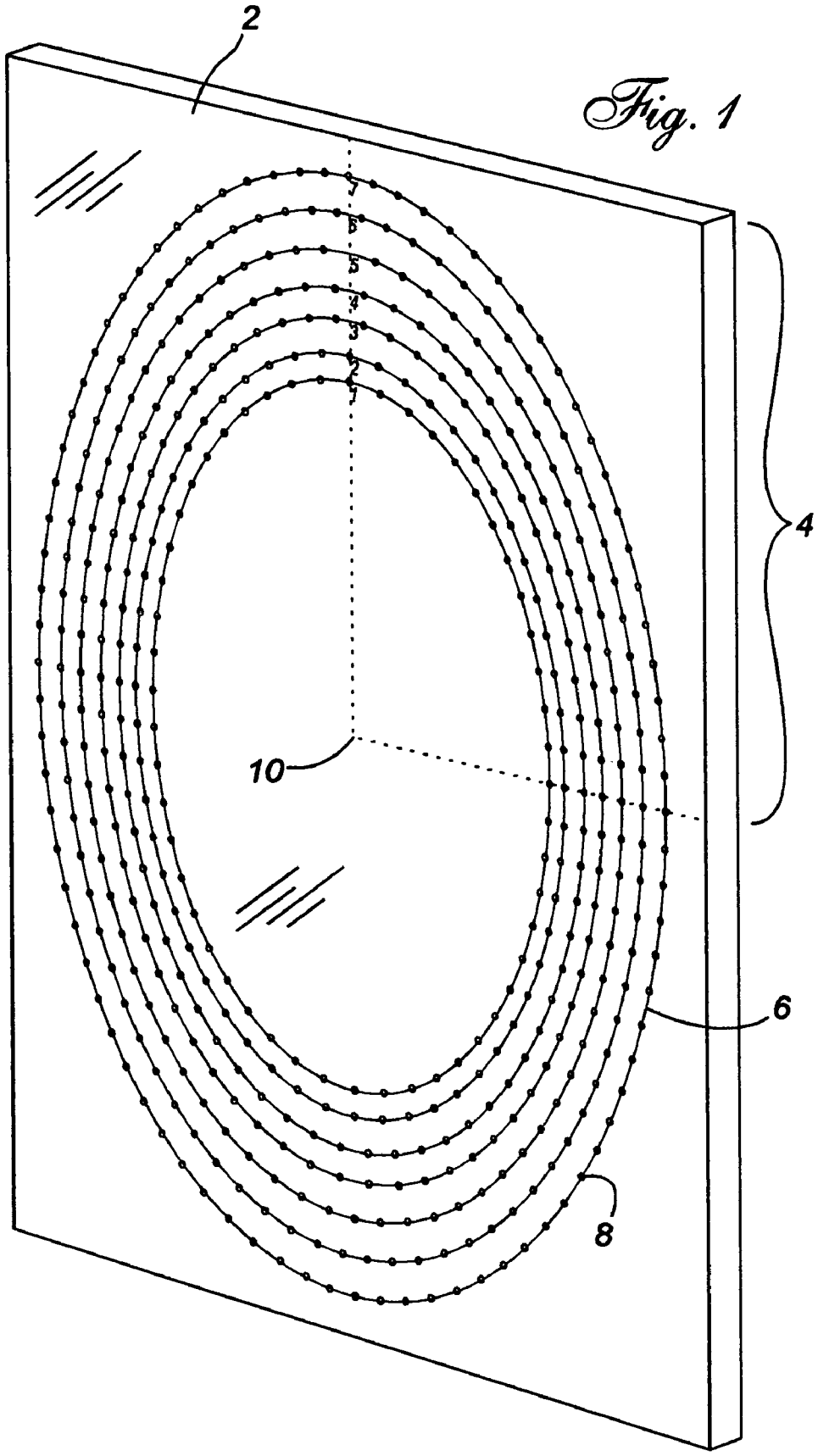
FIG. 1 is a perspective view from above of an embodiment of the pelting system of the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to the drawings, in particular, FIG. 1 which illustrates an embodiment of the pelting system of the present invention comprising: a rigid planar sheet material 2, such as plywood, a template guide 6, and a plurality of evenly-spaced perforations 8. The perforations 8 traversing through the rigid planar sheet material are tilted outwardly when viewed from the rear to the front of said sheet and each perforation 8 is beveled at entry in order to promote easy entry of nails 7 during use. In an alternate embodiment, a thin printed paper sheet can be provided having one quarter of the template as shown in indicia 4 in reference to a central point 10 so as to enable a user to perform the perforations onto a sheet material of his/her choice.

Figure 2:
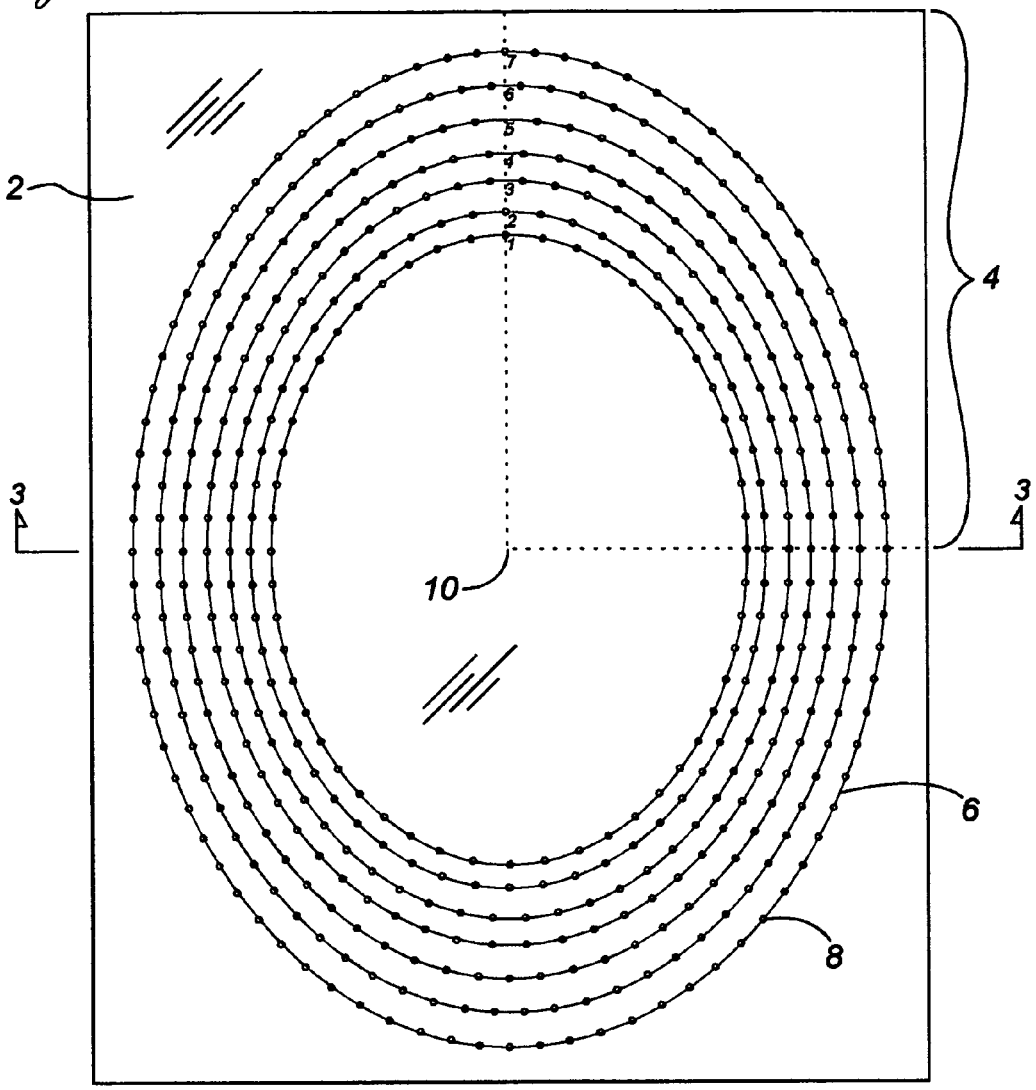
FIG. 2 is a front elevation view of an embodiment of the pelting system of the present invention.

Turning now to FIG. 2, a front elevation view of an embodiment of the pelting system of the present invention depicting: a rigid planar sheet material 2, template guide 6, and a plurality of evenly-spaced perforations 8 wherein when stretching a pelt into a desired oval shape, the user can apply more force on any edge while the pelt is still flexible and adaptable so as to not waste any fur in order to end with an oval pelt. Again, a user can utilize a thin printed-paper template of one quarter the full template to mark the locations of the many perforations 8 arrayed at a common point 10 thereby enabling the user to select the rigid sheet material of his/her choice.

Figure 3:
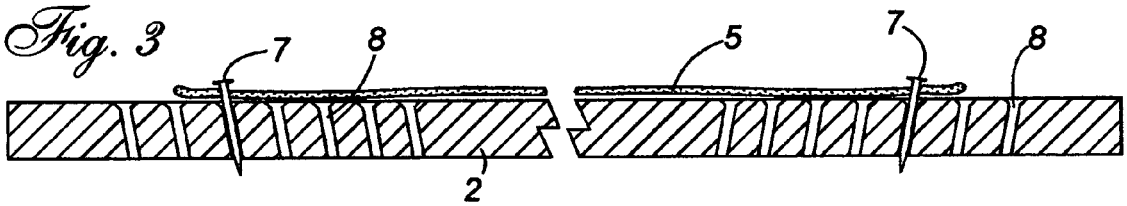
FIG. 3 is a cross-sectional view taken from FIG. 2 of an embodiment of the pelting system of the present invention.

FIG. 3 illustrates a cross-sectional view taken from FIG. 2. Specifically, the perforations 8 also have diameters which are slightly greater than the outside diameters of the nails 7, to permit releasable securement of the nails 7 therein. FIG. 3 further depicts the tilt of said perforations 8 into the rigid sheet material 2. This provides assurance that the nails 7 will not slide out form their desire inserted position within the perforations 8 when the pelt 5 dries and attempts to shrink.

Figure 4:
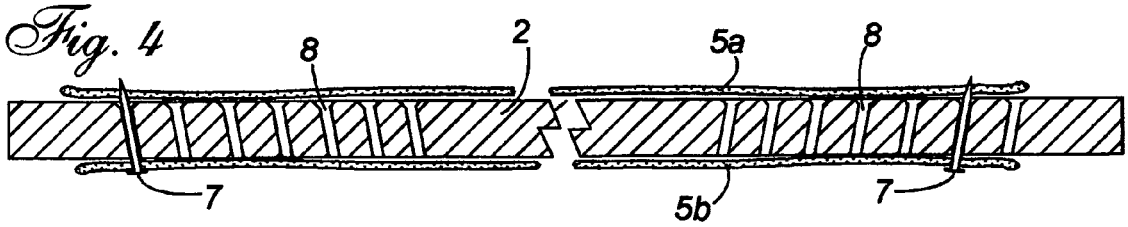
FIG. 4 is an alternate cross-sectional view taken from FIG. 2 of an embodiment of the pelting system of the present invention.

Referring now to FIG. 4, a similar depiction as FIG. 3 further illustrating an alternative method wherein two pelts 5*a* and 5*b* may be stretched at once, enabling a more cost effective use of the rigid template sheet. First, a user installs the first pelt 5*b* as in FIG. 3, then, before it begins to dry, the user can stretch a second pelt 5*a* on the reverse side of sheet 2 using the same nails 7 as used with the first pelt 5*a* installation. Due to the tilt of the perforations 8, the outward-pointing nails will suffice in holding the second pelt 5*a* in place, even when under stress when drying.

Therefore, fur trappers and traders can all benefit from evenly stretched pelts that are not only of the desired form but made to the largest size possible without the commonly know waste using conventional methods and devices. Furthermore, traders will further benefit from the pelts in that sellers can get more financial reward by producing higher quality pelts at a more efficient cost, and buyers will benefit from more usable area of said pelts.

The embodiments of the invention in which an exclusive property or privilege is claimed are defined as follows:

What I claim as my invention:

1. An apparatus for stretching and drying a pelt, said apparatus comprising a rigid planar member having a front side and a rear side and a plurality of perforations extending from said front side to said rear side, said perforations being spaced and aligned in the form of a first ring suitable for stretching and drying said pelt, wherein each of said perforations releasably receives a nail, such that said pelt is secured to said apparatus by inserting nails through said pelt and sliding pointed ends of the nails into said perforations, and further comprising a plurality of second perforations extending from said front side to said rear side of the rigid planar member, said second perforations being spaced and aligned in the form of a second ring, such that said second ring of perforations is positioned inside of said first ring of perforations.

2. An apparatus for stretching and drying a pelt as claimed in claim 1, wherein said first ring is-oval.

3. An apparatus for stretching and drying a pelt as claimed in claim 1, wherein said first and second rings are oval.

4. An apparatus for stretching and drying a pelt as claimed in claim 1, wherein said rigid planar member is a sheet of plywood.

5. An apparatus for stretching and drying a pelt as claimed in claim 1, wherein at least one of said plurality of perforations is bevelled so as to ease the entry of the pointed end of one of said nails into said perforation.

6. An apparatus for stretching and drying a pelt as claimed in claim 1, wherein at least one of said perforations is angled relative to a normal projecting perpendicularly to said front side of said rigid planar member to provide assurance that the nails do not slide out of the perforations as the pelt dries.

7. An apparatus for stretching and drying a pelt as claimed in claim 5, wherein at least one of said perforations is angled relative to a normal projecting perpendicularly to said front side of said rigid planar member.

8. An apparatus for stretching and drying a pelt as claimed in claim 1, the apparatus further comprising a plurality of nails which are inserted through the pelt and into a corresponding perforation.

9. An apparatus for stretching and drying a pelt as claimed in claim 1, wherein at least one of said perforations has a diameter which is slightly greater than an outside diameter of an associated one of the nails such that the associated nail is slidable in the perforation.

10. A method of stretching and drying a pelt comprising the steps of:

positioning, on a surface of a rigid planar member, a template, said template comprising a sheet material having a plurality of markers printed thereon, said markers being spaced and aligned on the template in the form of at least a section of a shape suitable for stretching and drying the pelt;

forming perforations for receiving nails in said rigid planar member using said template as a guide, said perforations being sized to have perforation diameters larger than outside diameters of said nails; and sequentially passing a pointed end of each of the nails through the pelt; and inserting the pointed end of each nail that has passed through the pelt into one of the perforations.

11. A method of stretching and drying a pelt as claimed in claim 10, wherein said shape is oval.

12. A method of making an apparatus for stretching and drying a pelt as claimed in claim 10, further comprising the step of forming a bevelled edge on each of said perforations prior to inserting a pointed end of one of the nails.

13. A method of stretching and drying a pelt as claimed in claim 10, wherein said step of forming perforations in said rigid planar member includes forming said perforations at an angle to a normal projecting perpendicularly to said surface of said rigid planar member, the perforations being angled away from a center of the shape such that the received nails do not slide out of the perforations as the pelt dries.

14. The use of the apparatus as claimed in claim 1, to stretch and dry a pelt on one of said front side and said rear side.

15. The use of the apparatus as claimed in claim 14, further comprising using the apparatus to simultaneously stretch and dry a second pelt on the other of said front and said rear side of said rigid planar member.

* * * * *